US006646175B1

(12) United States Patent
Dath et al.

(10) Patent No.: US 6,646,175 B1
(45) **Date of Patent: *Nov. 11, 2003**

(54) PRODUCTION OF OLEFINS

(75) Inventors: Jean-Pierre Dath, Beloeil (BE); Luc Delorme, Waterloo (BE); Jacques-François Grootjans, Leefdaal (BE); Xavier Vanhaeren, Genval (BE); Walter Vermeiren, Houthalen (BE)

(73) Assignee: Fina Research S.A., Feluy (BE)

( * ) Notice: Subject to any disclaimer, the term of this patent is extended or adjusted under 35 U.S.C. 154(b) by 0 days.

This patent is subject to a terminal disclaimer.

(21) Appl. No.: 09/206,207

(22) Filed: Dec. 5, 1998

(30) Foreign Application Priority Data

Dec. 5, 1997 (EP) ..... 97121388

(51) Int. Cl.[7] ..... C07C 4/06; C10G 11/05

(52) U.S. Cl. ..... 585/651; 585/653; 208/118; 208/120.01

(58) Field of Search ..... 585/651, 653; 208/118, 120.01; 502/77, 85

(56) References Cited

U.S. PATENT DOCUMENTS

| | | | | | |
|---|---|---|---|---|---|
| 3,506,400 | A | * | 4/1970 | Eberly, Jr. et al. | 423/713 |
| 4,078,011 | A | * | 3/1978 | Glockner et al. | 585/262 |
| 4,876,411 | A | * | 10/1989 | Bowes et al. | 585/533 |
| 4,954,243 | A | * | 9/1990 | Kuehl et al. | 208/120.01 |
| 5,120,893 | A | * | 6/1992 | Gabriel et al. | 585/653 |

FOREIGN PATENT DOCUMENTS

| | | | |
|---|---|---|---|
| EP | 0 109 059 | * | 5/1984 |
| EP | 0 109 060 | * | 5/1984 |

* cited by examiner

*Primary Examiner*—Walter D. Griffin
(74) *Attorney, Agent, or Firm*—William D. Jackson

(57) ABSTRACT

A process for the catalytic cracking of at least one olefin in an olefinic stream containing impurities, the cracking process being selective towards light olefins in the effluent, the process comprising contacting a feedstock olefinic stream containing at least one sulphur-, nitrogen- and/or oxygen-derivative impurity with a crystalline silicate catalyst of the MFI-type, the catalyst having a silicon/aluminum atomic ratio of at least about 180, to produce an effluent stream having substantially the same olefinic content by weight as, but a different olefin distribution than, the feedstock stream.

21 Claims, 6 Drawing Sheets

PRODUCTION OF OLEFINS

BACKGROUND TO THE INVENTION

The present invention relates to a process for cracking an olefin-rich hydrocarbon feedstock which is selective towards light olefins in the effluent. In particular, olefinic feedstocks from refineries or petrochemical plants can be converted selectively so as to redistribute the olefin content of the feedstock in the resultant effluent. More particularly, the present invention relates to such a process which is resistant to impurities contained in the feedstock.

DESCRIPTION OF THE PRIOR ART

It is known in the art to use zeolites to convert long chain paraffins into lighter products, for example in the catalytic dewaxing of petroleum feedstocks. While it is not the objective of dewaxing, at least parts of the paraffinic hydrocarbons are converted into olefins. It is known in such processes to use crystalline silicates for example of the MFI type, the three-letter designation "MFI" representing a particular crystalline silicate structure type as established by the Structure Commission of the International Zeolite Association. Examples of a crystalline silicate of the MFI type are the synthetic zeolite ZSM-5 and silicalite and other MFI type crystalline silicates are known in the art.

GB-A-1323710 discloses a dewaxing process for the removal of straight-chain paraffins and slightly branched-chain paraffins, from hydrocarbon feedstocks utilising a crystalline silicate catalyst, in particular ZSM-5. U.S. Pat. No. 4,247,388 also discloses a method of catalytic hydrodewaxing of petroleum and synthetic hydrocarbon feedstocks using a crystalline silicate of the ZSM-5 type. Similar dewaxing processes are disclosed in U.S. Pat. No. 4,284,529 and U.S. Pat. No. 5,614,079. The catalysts are crystalline alumino- silicates and the above-identified prior art documents disclose the use of a wide range of Si/Al ratios and differing reaction conditions for the disclosed dewaxing processes.

GB-A-2185753 discloses the dewaxing of hydrocarbon feedstocks using a silicalite catalyst. U.S. Pat. No. 4,394,251 discloses hydrocarbon conversion with a crystalline silicate particle having an aluminum-containing outer shell.

It is also known in the art to effect selective conversion of hydrocarbon feeds containing straight-chain and/or slightly branched-chain hydrocarbons, in particular paraffins, into a lower molecular weight product mixture containing a significant amount of olefins. The conversion is effected by contacting the feed with a crystalline silicate known as silicalite, as disclosed in GB-A-2075045, U.S. Pat. No. 4,401,555 and U.S. Pat. No. 4,309,276. Silicalite is disclosed in U.S. Pat. No. 4,061,724.

Silicalite catalysts exist having varying silicon/aluminum atomic ratios and different crystalline forms. EP-A-0146524 and 0146525 in the name of Cosden Technology, Inc. disclose crystalline silicas of the silicalite type having monoclinic symmetry and a process for their preparation. These silicates have a silicon to aluminum atomic ratio of greater than 80.

WO-A-97/04871 discloses the treatment of a medium pore zeolite with steam followed by treatment with an acidic solution for improving the butene selectivity of the zeolite in catalytic cracking.

A paper entitled "De-alumination of HZSM-5 zeolites: Effect of steaming on acidity and aromatization activity", de Lucas et al, Applied Catalysis A: General 154 1997 221–240, published by Elsevier Science B.V. discloses the conversion of acetone/n-butanol mixtures to hydrocarbons over such dealuminated zeolites.

It is yet further known, for example from U.S. Pat. No. 4,171,257, to dewax petroleum distillates using a crystalline silicate catalyst such as ZSM-5 to produce a light olefin fraction, for example a $C_3$ to $C_4$ olefin fraction. Typically, the reactor temperature reaches around 500° C. and the reactor employs a low hydrocarbon partial pressure which favours the conversion of the petroleum distillates into propylene. Dewaxing cracks paraffinic chains leading to a decrease in the viscosity of the feedstock distillates, but also yields a minor production of olefins from the cracked paraffins.

EP-A-0305720 discloses the production of gaseous olefins by catalytic conversion of hydrocarbons. EP-B-0347003 discloses a process for the conversion of a hydrocarbonaceous feedstock into light olefins. WO-A-90/11338 discloses a process for the conversion of $C_2$–$C_{12}$ paraffinic hydrocarbons to petrochemical feedstocks, in particular to $C_2$ to $C_4$ olefins. U.S. Pat. No. 5,043,522 and EP-A-0395345 disclose the production of olefins from paraffins having four or more carbon atoms. EP-A-0511013 discloses the production of olefins from hydrocarbons using a steam activated catalyst containing phosphorous and H-ZSM-5. U.S. Pat. No. 4,810,356 discloses a process for the treatment of gas oils by dewaxing over a silicalite catalyst. GB-A-2156845 discloses the production of isobutylene from propylene or a mixture of hydrocarbons containing propylene. GB-A-2159833 discloses the production of a isobutylene by the catalytic cracking of light distillates.

It is known in the art that for the crystalline silicates exemplified above, long chain olefins tend to crack at a much higher rate than the corresponding long chain paraffins.

It is further known that when crystalline silicates are employed as catalysts for the conversion of paraffins into olefins, such conversion is not stable against time. The conversion rate decreases as the time on stream increases, which is due to formation of coke (carbon) which is deposited on the catalyst.

These known processes are employed to crack heavy paraffinic molecules into lighter molecules. However, when it is desired to produce propylene, not only are the yields low but also the stability of the crystalline silicate catalyst is low. For example, in an FCC unit a typical propylene output is 3.5 wt %. The propylene output may be increased to up to about 7–8 wt % propylene from the FCC unit by introducing the known ZSM-5 catalyst into the FCC unit to "squeeze" out more propylene from the incoming hydrocarbon feedstock being cracked. Not only is this increase in yield quite small, but also the ZSM-5 catalyst has low stability in the FCC unit.

There is an increasing demand for propylene in particular for the manufacture of polypropylene.

The petrochemical industry is presently facing a major squeeze in propylene availability as a result of the growth in propylene derivatives, especially polypropylene. Traditional methods to increase propylene production are not entirely satisfactory. For example, additional naphtha steam cracking units which produce about twice as much ethylene as propylene are an expensive way to yield propylene since the feedstock is valuable and the capital investment is very high. Naphtha is in competition as a feedstock for steam crackers because it is a base for the production of gasoline in the refinery. Propane dehydrogenation gives a high yield of propylene but the feedstock (propane) is only cost effective during limited periods of the year, making the process expensive and limiting the production of propylene. Propylene is obtained from FCC units but at a relatively low yield and increasing the yield has proven to be expensive and limited. Yet another route known as metathesis or disproportionation enables the production of propylene from ethylene and butene. Often, combined with a steam cracker, this technology is expensive since it uses ethylene as a feedstock which is at least as valuable as propylene.

EP-A-0109059 discloses a process for converting olefins having 4 to 12 carbon atoms into propylene. The olefins are contacted with an alumino-silicate having a crystalline and zeolite structure (e.g. ZSM-5 or ZSM-11) and having a $SiO_2/Al_2O_3$ molar ratio equal to or lower than 300. The specification requires high space velocities of greater than 50 kg/h per kg of pure zeolite in order to achieve high propylene yield. The specification also states that generally the higher the space velocity the lower the $SiO_2/Al_2O_3$ molar ratio (called the Z ratio). This specification only exemplifies olefin conversion processes over short periods (e.g. a few hours) and does not address the problem of ensuring that the catalyst is stable over longer periods (e.g. at least 160 hours or a few days) which are required in commercial production. Moreover, the requirement for high space velocities is undesirable for commercial implementation of the olefin conversion process.

Thus there is a need for a high yield propylene production method which can readily be integrated into a refinery or petrochemical plant, taking advantage of feedstocks that are less valuable for the market place (having few alternatives on the market).

On the other hand, crystalline silicates of the MFI type are also well known catalysts for the oligomerisation of olefins. For example, EP-A-0031675 discloses the conversion of olefin-containing mixtures to gasoline over a catalyst such as ZSM-5. As will be apparent to a person skilled in the art, the operating conditions for the oligomerisation reaction differ significantly from those used for cracking. Typically, in the oligomerisation reactor the temperature does not exceed around 400° C. and a high pressure favours the oligomerisation reactions.

GB-A-2156844 discloses a process for the isomerisation of olefins over silicalite as a catalyst. U.S. Pat. No. 4,579,989 discloses the conversion of olefins to higher molecular weight hydrocarbons over a silicalite catalyst. U.S. Pat. No. 4,746,762 discloses the upgrading of light olefins to produce hydrocarbons rich in $C_5$+ liquids over a crystalline silicate catalyst. U.S. Pat. No. 5,004,852 discloses a two-stage process for conversion of olefins to high octane gasoline wherein in the first stage olefins are oligomerised to $C_5$+ olefins. U.S. Pat. No. 5,171,331 discloses a process for the production of gasoline comprising oligomerising a $C_2$–$C_6$ olefin containing feedstock over an intermediate pore size siliceous crystalline molecular sieve catalyst such as silicalite, halogen stabilised silicalite or a zeolite. U.S. Pat. No. 4,414,423 discloses a multistep process for preparing high-boiling hydrocarbons from normally gaseous hydrocarbons, the first step comprising feeding normally gaseous olefins over an intermediate pore size siliceous crystalline molecular sieve catalyst. U.S. Pat. No. 4,417,088 discloses the dimerising and trimerising of high carbon olefins over silicalite. U.S. Pat. No. 4,417,086 discloses an oligomerisation process for olefins over silicalite. GB-A-2106131 and GB-A-2106132 disclose the oligomerisation of olefins over catalysts such as zeolite or silicalite to produce high boiling hydrocarbons. GB-A-2106533 discloses the oligomerisation of gaseous olefins over zeolite or silicalite.

It is known that hydrocarbon feedstocks can contain impurities including nitrogen, oxygen and sulphur heteroatoms. Such impurities act as poisons for crystalline silicate catalysts, thus reducing the catalyst activity and product yield over time. There is a need for crystalline silicate catalysts coupled with selected process conditions which are resistant to such impurities, leading to the opportunity to use a variety of feedstocks of varying purity in the hydrocarbon conversion process.

SUMMARY OF THE INVENTION

It is an object of the present invention to provide a process for using the less valuable olefins present in refinery and petrochemical plants as a feedstock for a process which, in contrast to the prior art processes referred to above, catalytically converts olefins into lighter olefins, and in particular propylene.

It is also an object of the invention to provide such a process wherein the olefin feedstock contains impurities, in particular sulphur-, nitrogen- and oxygen-derivative containing impurities.

It is another object of the invention to provide a process for producing propylene having a high propylene yield and purity.

It is a further object of the present invention to provide such a process which can produce olefin effluents which are within, at least, a chemical grade quality.

It is yet a further object of the present invention to provide a process for producing olefins having a stable olefinic conversion and a stable product distribution over time.

It is yet a further object of the present invention to provide a process for converting olefinic feedstocks having a high yield on an olefin basis towards propylene, irrespective of the origin and composition of the olefinic feedstock.

It is still a further object of the invention to provide a process for olefin catalytic cracking wherein the catalyst has high stability, for example capable of giving a stable olefin yield over a significant period of time, typically several days.

It is another object of the invention to provide a catalytic cracking process employing such a catalyst which has high flexibility so that it can operate with a variety of different feedstocks, which may be mixtures.

The present invention provides a process for the catalytic cracking of at least one olefin in an olefinic stream containing impurities, the cracking process being selective towards light olefins in the effluent, the process comprising contacting a feedstock olefinic stream containing at least one sulphur-, nitrogen- and/or oxygen-derivative impurity with a crystalline silicate catalyst of the MFI-type, the catalyst having a silicon/aluminum atomic ratio of at least about 180, to produce an effluent stream having substantially the same olefinic content by weight as, but a different olefin distribution than, the feedstock stream.

The present invention can thus provide a process wherein olefin-rich hydrocarbon streams (products) from refinery and petrochemical plants are selectively cracked not only into light olefins, but particularly into propylene. In one preferred embodiment the olefin-rich feedstock may be passed over a crystalline silicate catalyst with a particular Si/Al atomic ratio of from 180 to 1000 obtained after a steaming/de-alumination treatment. Alternatively the olefin-rich feedstock may be passed over a commercially available catalyst of the ZSM-5 type which has been prepared by crystallisation using an organic template and has been unsubjected to any subsequent steaming or de-alumination process, the catalyst having a silicon/aluminum atomic ratio of from 300 to 1000. The feedstock may be passed over the catalyst at a temperature ranging between 500 to 600° C., an olefin partial pressure of from 0.1 to 2 bars and an LHSV of from 10 to $30h^{-1}$ to yield at least 30 to 50% propylene based on the olefin content in the feedstock.

In this specification, the term "silicon/aluminum atomic ratio" is intended to mean the Si/Al atomic ratio of the overall material, which may be determined by chemical analysis. In particular, for crystalline silicate materials, the stated Si/Al ratios apply not just to the Si/Al framework of the crystalline silicate but rather to the whole material.

The silicon/aluminum atomic ratio is greater than about 180. Even at silicon/aluminum atomic ratios less than about 180, the yield of light olefins, in particular propylene, as a result of the catalytic cracking of the olefin-rich feedstock may be greater than in the prior art processes. The feedstock may be fed either undiluted or diluted with an inert gas such as nitrogen. In the latter case, the absolute pressure of the feedstock constitutes the partial pressure of the hydrocarbon feedstock in the inert gas.

BRIEF DESCRIPTION OF THE DRAWINGS

The various aspects of the present invention will now be described in greater detail however by example only with reference to the accompanying drawings, in which.

DETAILED DESCRIPTION OF THE PREFERRED EMBODIMENTS

Figure 1:
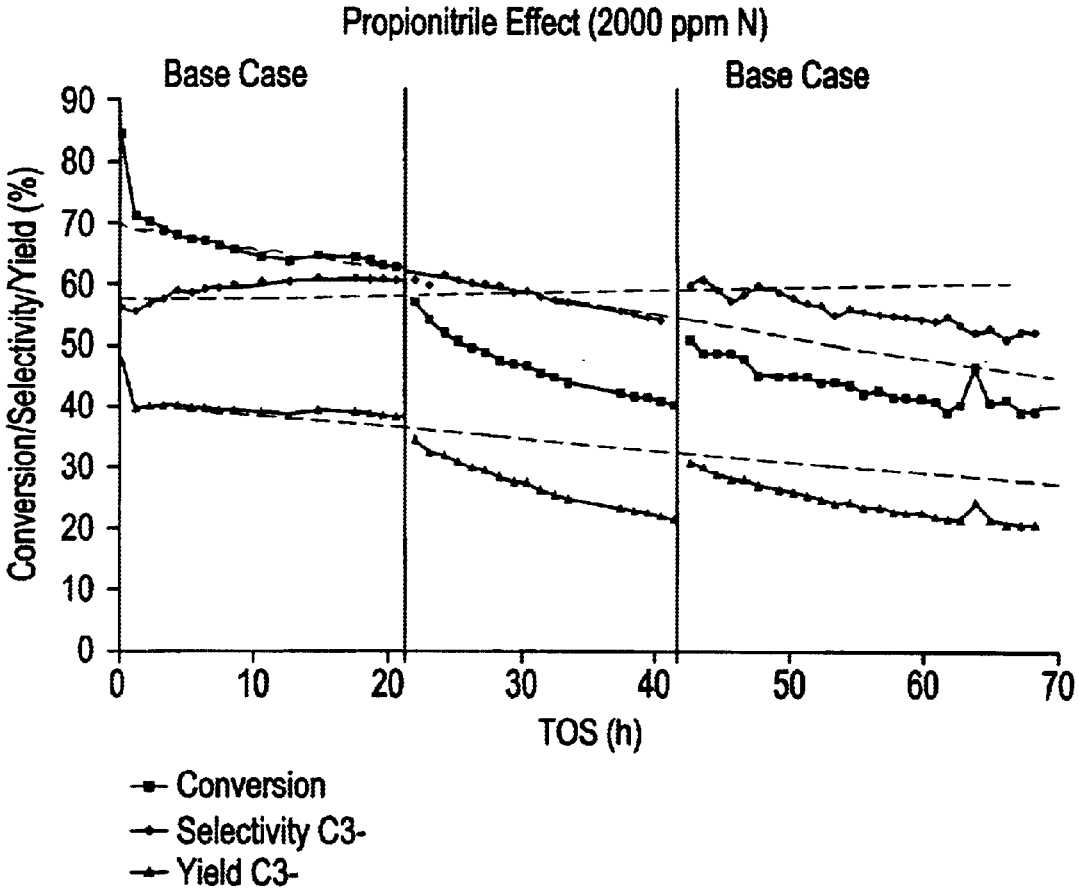
FIGS. 1 to 10 are graphs showing the relationship between the conversion of an olefinic feedstock, the yield of propylene on an olefin basis and the yield of propylene by weight with respect to time, in a number of runs to crack 1-hexene in the presence of heteroatoms in a simulation of a feedstock containing impurities including such heteroatoms.
Figure 2:
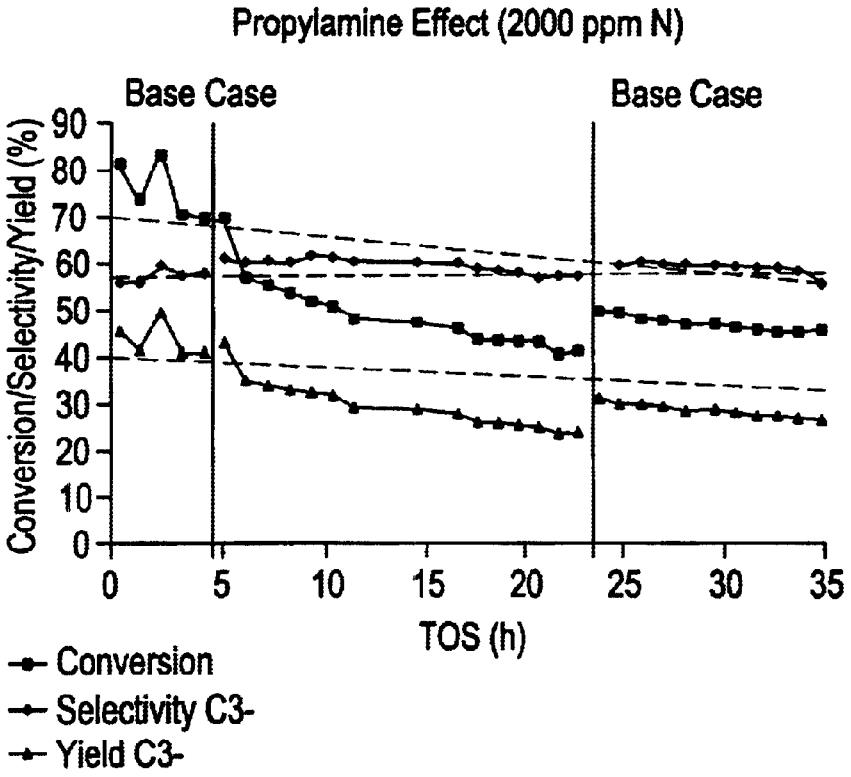
Figure 3:
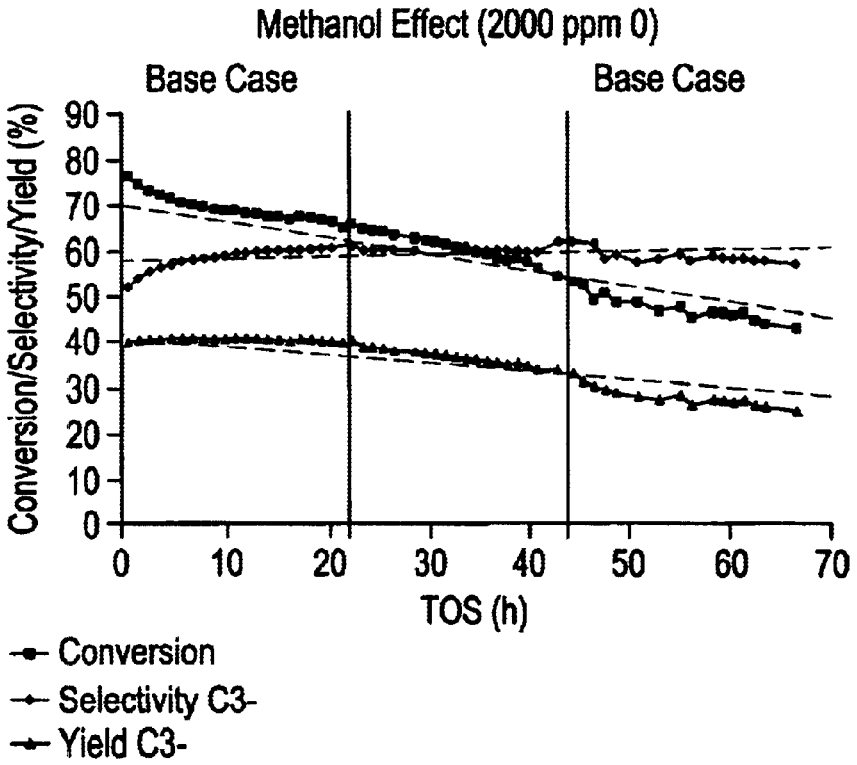
Figure 4:
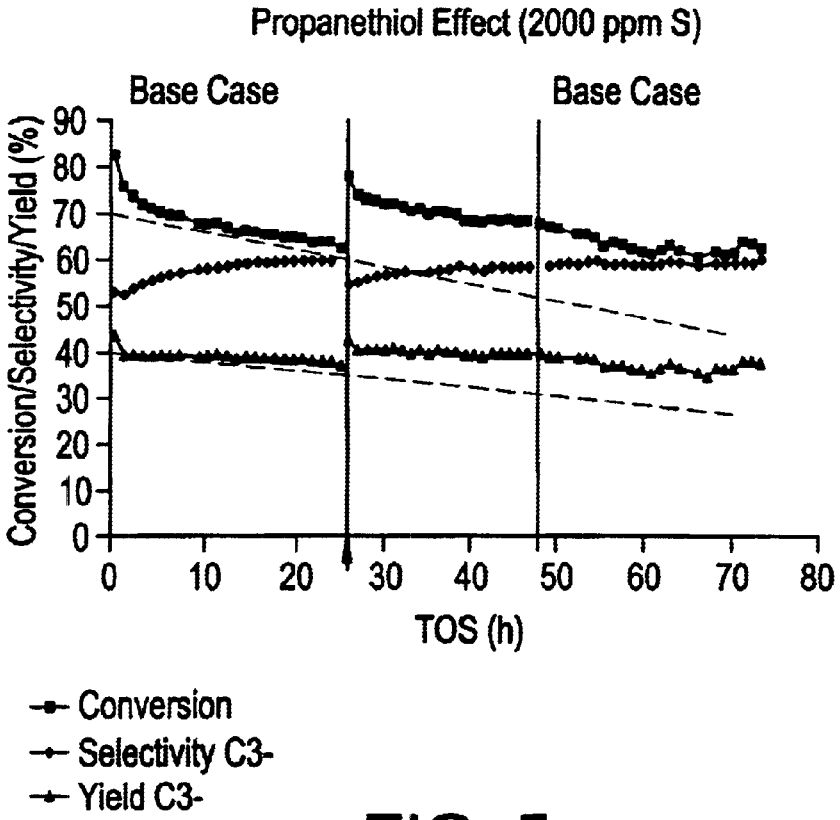
Figure 5:
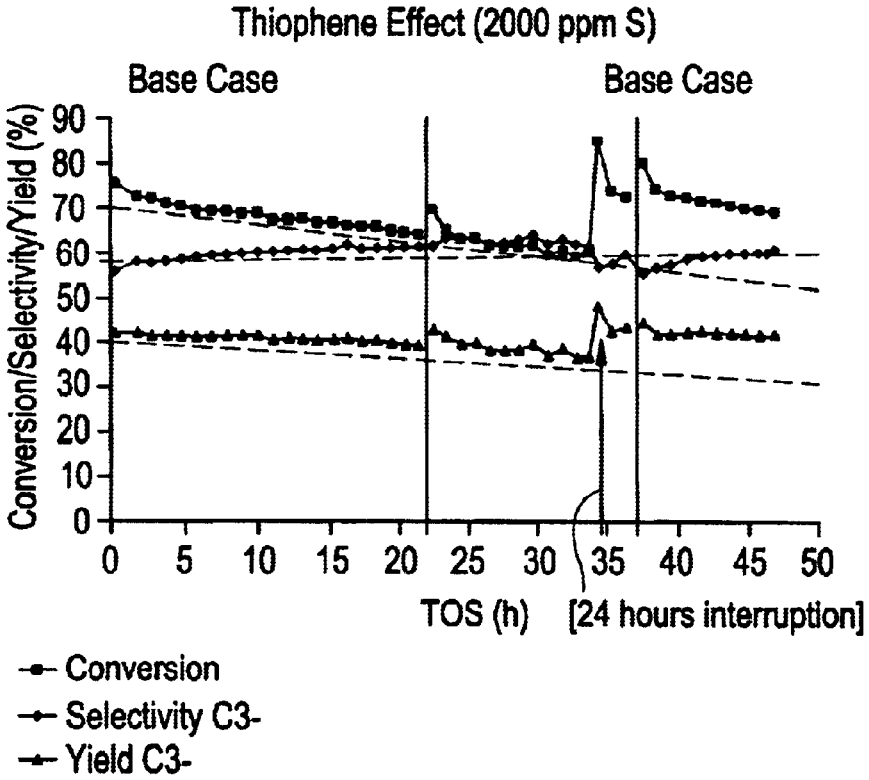
Figure 6:
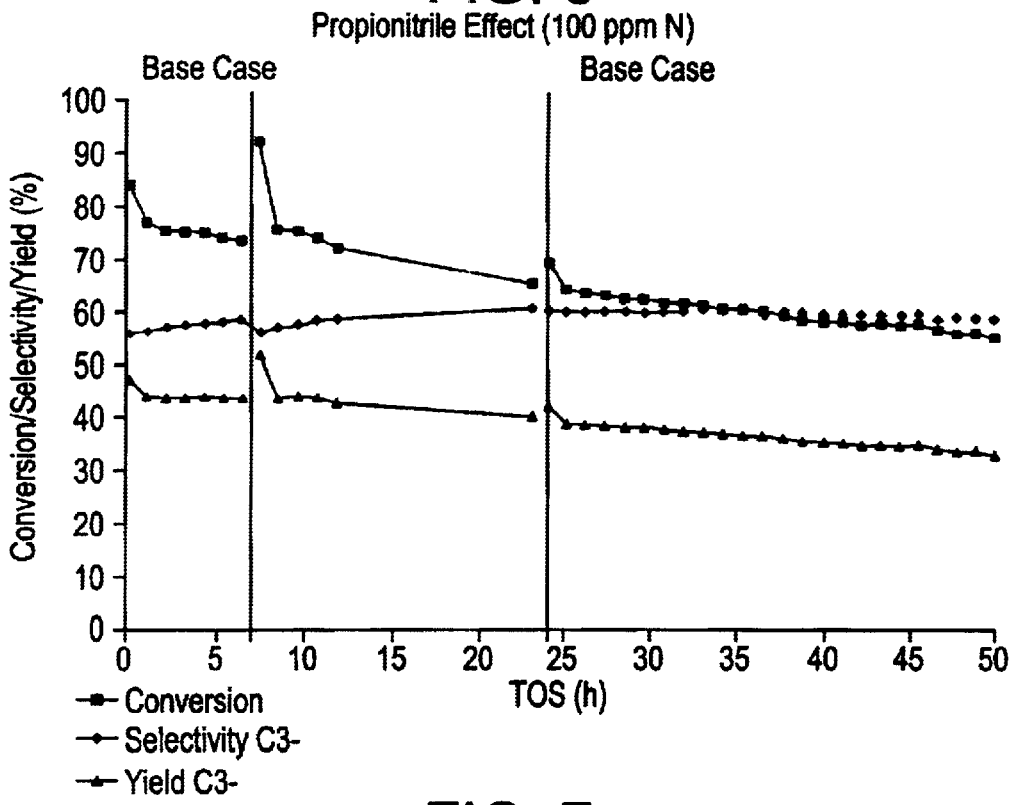
Figure 7:
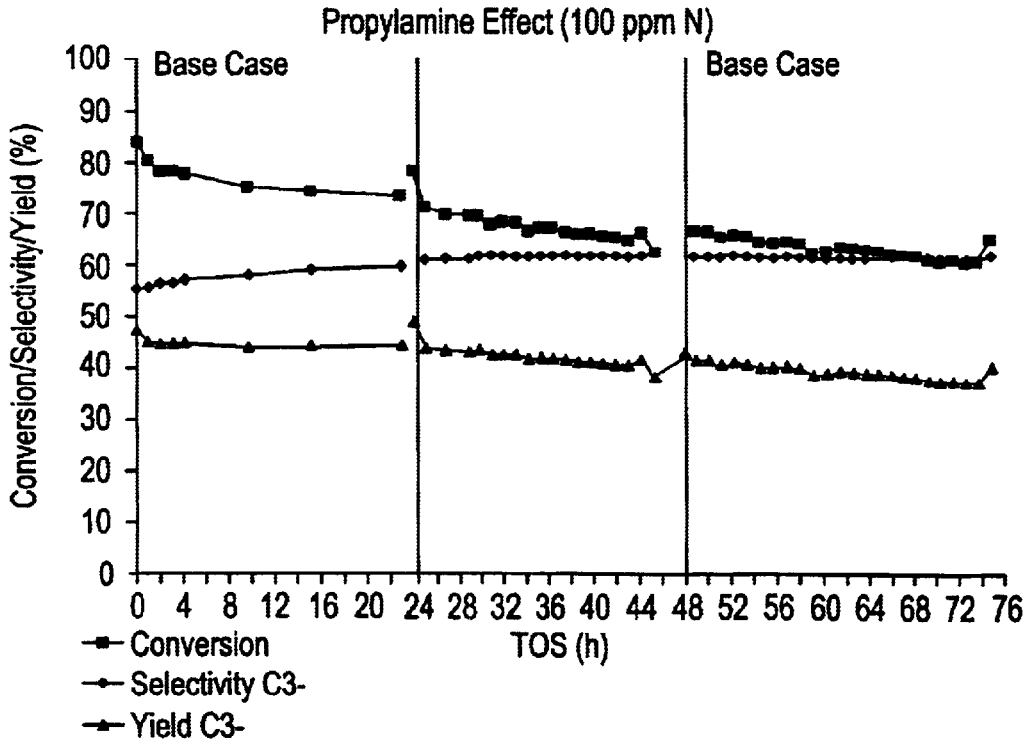
Figure 8:
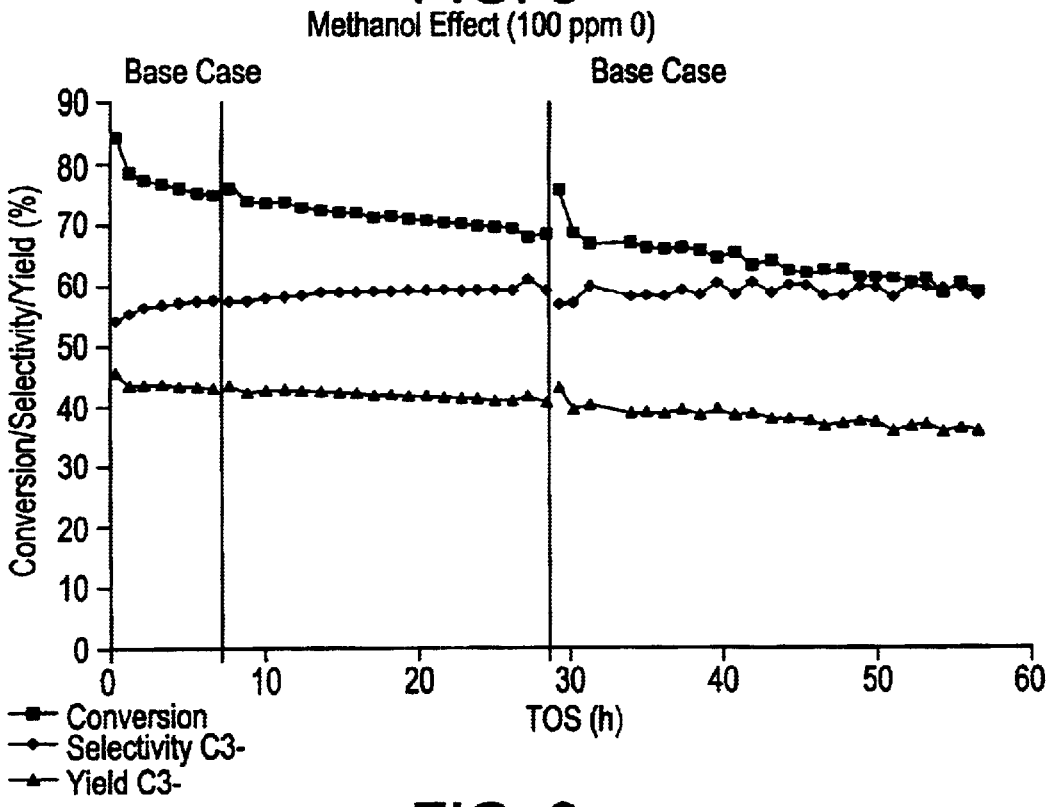
Figure 9:
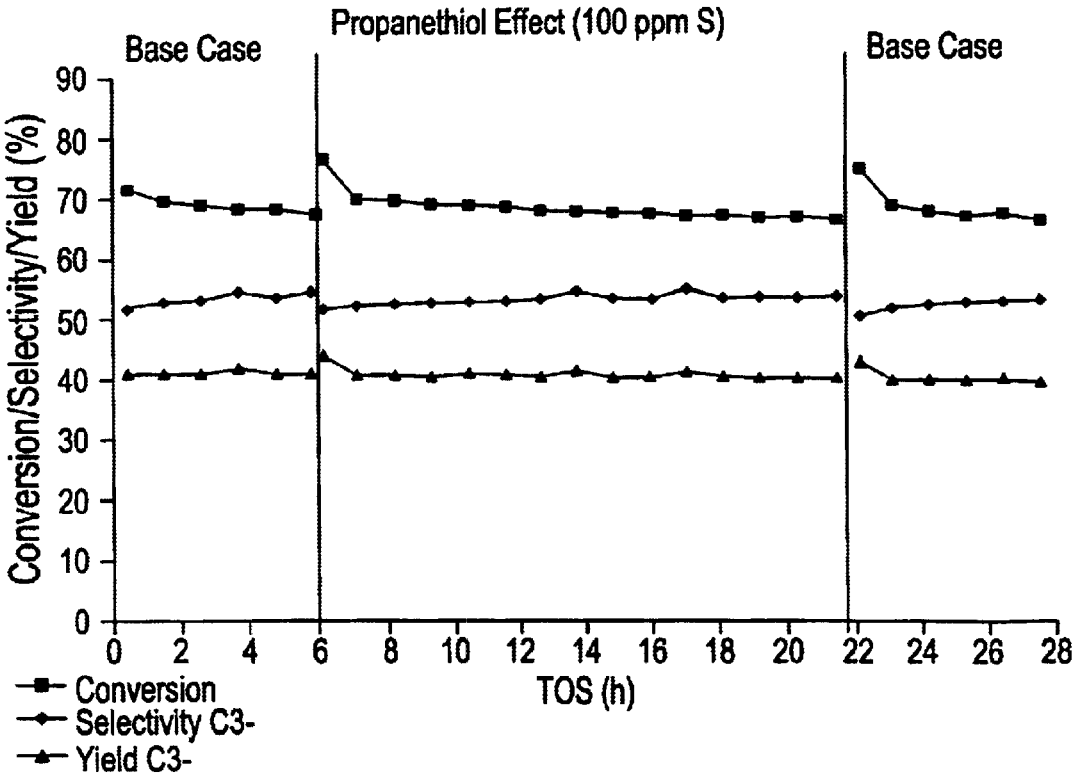
Figure 10:
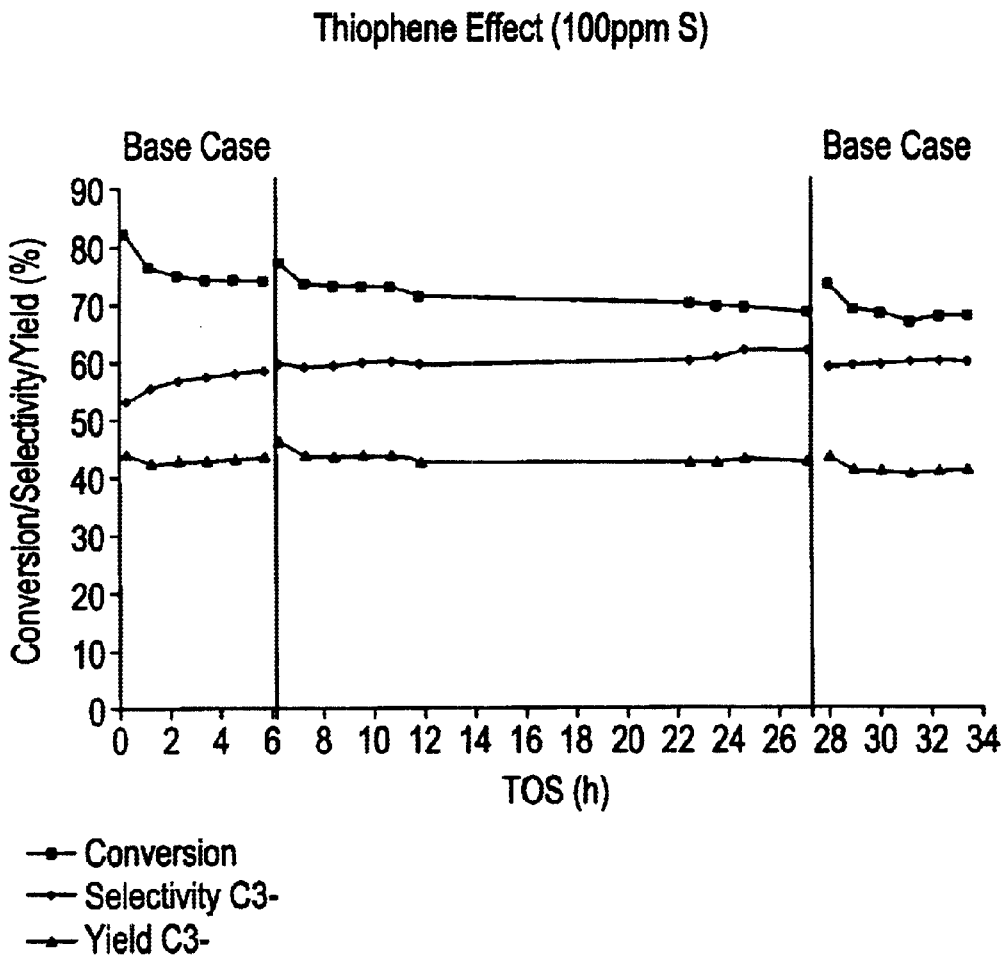

In accordance with the present invention, cracking of olefins is performed in the sense that olefins in a hydrocarbon stream are cracked into lighter olefins and selectively into propylene. The feedstock and effluent preferably have substantially the same olefin content by weight. Typically, the olefin content of the effluent is within ±15 wt %, more preferably ±10 wt %, of the olefin content of the feedstock. The feedstock may comprise any kind of olefin-containing hydrocarbon stream. The feedstock may typically comprise from 10 to 100 wt % olefins and furthermore may be fed undiluted or diluted by a diluent, the diluent optionally including a non-olefinic hydrocarbon. In particular, the olefin-containing feedstock may be a hydrocarbon mixture containing normal and branched olefins in the carbon range $C_4$ to $C_{10}$, more preferably in the carbon range $C_4$ to $C_6$, optionally in a mixture with normal and branched paraffins and/or aromatics in the carbon range $C_4$ to $C_{10}$. Typically, the olefin-containing stream has a boiling point of from around −15 to around 180° C.

In particularly preferred embodiments of the present invention, the hydrocarbon feedstocks comprise $C_4$ mixtures from refineries and steam cracking units. Such steam cracking units crack a wide variety of feedstocks, including ethane, propane, butane, naphtha, gas oil, fuel oil, etc. Most particularly, the hydrocarbon feedstock may comprises a $C_4$ cut from a fluidized-bed catalytic cracking (FCC) unit in a crude oil refinery which is employed for converting heavy oil into gasoline and lighter products. Typically, such a $C_4$ cut from an FCC unit comprises around 50 wt % olefin. Alternatively, the hydrocarbon feedstock may comprise a $C_4$ cut from a unit within a crude oil refinery for producing methyl tert-butyl ether (MTBE) which is prepared from methanol and isobutene. Again, such a $C_4$ cut from the MTBE unit typically comprises around 50 wt % olefin. These $C_4$ cuts are fractionated at the outlet of the respective FCC or MTBE unit. The hydrocarbon feedstock may yet further comprise a $C_4$ cut from a naphtha steam-cracking unit of a petrochemical plant in which naphtha, comprising $C_5$ to $C_9$ species having a boiling point range of from about 15 to 180° C., is steam cracked to produce, inter alia, a $C_4$ cut. Such a $C_4$ cut typically comprises, by weight, 40 to 50% 1,3-butadiene, around 25% isobutylene, around 15% butene (in the form of but-1-ene and/or but-2-ene) and around 10% n-butane and/or isobutane. The olefin-containing hydrocarbon feedstock may also comprise a $C_4$ cut from a steam cracking unit after butadiene extraction (raffinate 1), or after butadiene hydrogenation.

The feedstock may yet further alternatively comprise a hydrogenated butadiene-rich $C_4$ cut, typically containing greater than 50 wt % $C_4$ as an olefin. Alternatively, the hydrocarbon feedstock could comprise a pure olefin feedstock which has been produced in a petrochemical plant.

The olefin-containing feedstock may yet further alternatively comprise light cracked naphtha (LCN) (otherwise known as light catalytic cracked spirit (LCCS)) or a $C_5$ cut from a steam cracker or light cracked naphtha, the light cracked naphtha being fractionated from the effluent of the FCC unit, discussed hereinabove, in a crude oil refinery. Both such feedstocks contain olefins. The olefin-containing feedstock may yet further alternatively comprise a medium cracked naphtha from such an FCC unit or visbroken naphtha obtained from a visbreaking unit for treating the residue of a vacuum distillation unit in a crude oil refinery.

The olefin-containing feedstock may comprise a mixture of one or more of the above-described feedstocks.

The use of a $C_5$ cut as the olefin-containing hydrocarbon feedstock in accordance with a preferred process of the invention has particular advantages because of the need to remove $C_5$ species in any event from gasolines produced by the oil refinery. This is because the presence of $C_5$ in gasoline increases the ozone potential and thus the photochemical activity of the resulting gasoline. In the case of the use of light cracked naphtha as the olefin-containing feedstock, the olefin content of the remaining gasoline fraction is reduced, thereby reducing the vapour pressure and also the photochemical activity of the gasoline.

When converting light cracked naphtha, $C_2$ to $C_4$ olefins may be produced in accordance with the process of the invention. The $C_4$ fraction is very rich in olefins, especially in isobutene, which is an interesting feed for an MTBE unit. When converting a $C_4$ cut, $C_2$ to $C_3$ olefins are produced on the one hand and $C_5$ to $C_6$ olefins containing mainly iso-olefins are produced on the other hand. The remaining $C_4$ cut is enriched in butanes, especially in isobutane which is an interesting feedstock for an alkylation unit of an oil refinery wherein an alkylate for use in gasoline is produced from a mixture of $C_3$ and $C_5$ feedstocks. The $C_5$ to $C_6$ cut containing mainly iso-olefins is an interesting feed for the production of tertiary amyl methyl ether (TAME).

Surprisingly, the present inventors have found that in accordance with the process of the invention, olefinic feedstocks can be converted selectively so as to redistribute the olefinic content of the feedstock in the resultant effluent. The catalyst and process conditions are selected whereby the process has a particular yield on an olefin basis towards a specified olefin in the feedstocks. Typically, the catalyst and process conditions are chosen whereby the process has the same high yield on an olefin basis towards propylene irrespective of the origin of the olefinic feedstocks for example the $C_4$ cut from the FCC unit, the $C_4$ cut from the MTBE unit, the light cracked naphtha or the $C_5$ cut from the light crack naphtha, etc., This is quite unexpected on the basis of the prior art. The propylene yield on an olefin basis is typically from 30 to 50% based on the olefin content of the feedstock. The yield on an olefin basis of a particular olefin is defined as the weight of that olefin in the effluent divided by the initial total olefin content by weight. For example, for a feedstock with 50 wt % olefin, if the effluent contains 20 wt % propylene, the propylene yield on an olefin basis is 40%. This may be contrasted with the actual yield for a product which is defined as the weight amount of the product produced divided by the weight amount of the feed. The paraffins and the aromatics contained in the feedstock are only slightly converted in accordance with the preferred aspects of the invention.

In accordance with the present invention, the catalyst for the cracking of the olefins comprises a crystalline silicate of the MFI family which may be a zeolite (e.g. of the ZSM-5 type), a silicalite or any other silicate in that family.

The preferred crystalline silicates have pores or channels defined by ten oxygen rings and a high silicon/aluminum atomic ratio.

Crystalline silicates are microporous crystalline inorganic polymers based on a framework of $XO_4$ tetrahedra linked to each other by sharing of oxygen ions, where X may be trivalent (e.g. Al,B, . . . ) or tetravalent (e.g. Ge, Si, . . . ). The crystal structure of a crystalline silicate is defined by the specific order in which a network of tetrahedral units are linked together. The size of the crystalline silicate pore openings is determined by the number of tetrahedral units, or, alternatively, oxygen atoms, required to form the pores and the nature of the cations that are present in the pores. They possess a unique combination of the following properties: high internal surface area; uniform pores with one or more discrete sizes; ion exchangeability; good thermal stability; and ability to adsorb organic compounds. Since the pores of these crystalline silicates are similar in size to many organic molecules of practical interest, they control the ingress and egress of reactants and products, resulting in particular selectivity in catalytic reactions. Crystalline silicates with the MFI structure possess a bidirectional intersecting pore system with the following pore diameters: a straight channel along [010]:0.53–0.56 nm and a sinusoidal channel along [100]:0.51–0.55 nm.

The crystalline silicate catalyst has structural and chemical properties and is employed under particular reaction conditions whereby the catalytic cracking readily proceeds. Different reaction pathways can occur on the catalyst. Under the preferred process conditions, having an inlet temperature of around 500 to 600° C., more preferably from 520 to 600° C., yet more preferably 540 to 580° C., and an olefin partial pressure of from 0.1 to 2 bars, most preferably around atmospheric pressure, the shift of the double bond of an olefin in the feedstock is readily achieved, leading to double bond isomerisation. Furthermore, such isomerisation tends to reach a thermodynamic equilibrium. Propylene can be, for example, directly produced by the catalytic cracking of hexene or a heavier olefinic feedstock. Olefinic catalytic cracking may be understood to comprise a process yielding shorter molecules via bond breakage.

The catalyst preferably has a high silicon/aluminum atomic ratio, e.g. at least about 180, preferably greater than about 200, more preferably greater than about 300, whereby the catalyst has relatively low acidity. Hydrogen transfer reactions are directly related to the strength and density of the acid sites on the catalyst, and such reactions are preferably suppressed so as to avoid the formation of coke during the olefin conversion process, which in turn would otherwise decrease the stability of the catalyst over time. Such hydrogen transfer reactions tend to produce saturates such as paraffins, intermediate unstable dienes and cyclo-olefins, and aromatics, none of which favours cracking into light olefins. Cyclo-olefins are precursors of aromatics and coke-like molecules, especially in the presence of solid acids, i.e. an acidic solid catalyst. The acidity of the catalyst can be determined by the amount of residual ammonia on the catalyst following contact of the catalyst with ammonia which adsorbs to the acid sites on the catalyst with subsequent ammonium desorption at elevated temperature measured by differential thermogravimetric analysis. Preferably, the silicon/aluminum ratio ranges from 180 to 1000, most preferably from 300 to 500.

One of the features of the invention is that with such high silicon/aluminum ratio in the crystalline silicate catalyst, a stable olefin conversion can be achieved with a high propylene yield on an olefin basis of from 30 to 50% whatever the origin and composition of the olefinic feedstock. Such high ratios reduce the acidity of the catalyst, thereby increasing the stability of the catalyst.

In accordance with one preferred aspect of the invention, the catalyst having a high silicon/aluminum atomic ratio for use in the catalytic cracking process of the present invention is manufactured by removing aluminum from a commercially available crystalline silicate. A typical commercially available silicalite has a silicon/aluminum atomic ratio of around 120. In accordance with the present invention, the commercially available crystalline silicate is modified by a steaming process which can reduce the tetrahedral aluminum in the crystalline silicate framework and convert the aluminum atoms into octahedral aluminum in the form of amorphous alumina. Although in the steaming step aluminum atoms are chemically removed from the crystalline silicate framework structure to form alumina particles, those particles cause partial obstruction of the pores or channels in the framework. This inhibits the olefinic cracking processes of the present invention. Accordingly, following the steaming step, the crystalline silicate is subjected to an extraction step wherein amorphous alumina is removed from the pores and the micropore volume is, at least partially, recovered. The physical removal, by a leaching step, of the amorphous alumina from the pores by the formation of a water-soluble aluminum complex yields the overall effect of de-alumination of the crystalline silicate. In this way by removing aluminum from the crystalline silicate framework and then removing alumina formed therefrom from the pores, the process aims at achieving a substantially homogeneous de-alumination throughout the whole pore surfaces of the catalyst. This reduces the acidity of the catalyst, and thereby reduces the occurrence of hydrogen transfer reactions in the cracking process. The reduction of acidity ideally occurs substantially homogeneously throughout the pores defined in the crystalline silicate framework. This is because in the olefin cracking process hydrocarbon species can enter deeply into the pores. Accordingly, the reduction of acidity and thus the reduction in hydrogen transfer reactions which would reduce the stability of the catalyst are pursued throughout the whole pore structure in the framework. In a preferred embodiment, the framework silicon/aluminum ratio is increased by this process to a value of at least about 180, preferably from about 180 to 1000, more preferably at least 200, yet more preferably at least 300, and most preferably around 480.

In accordance with an alternative preferred aspect of the invention the catalyst is a commercially available catalyst of the ZSM-5 type (for example a ZSM-5 type catalyst available in commerce from the company CU Chemie Ueticon AG of Switzerland under the trade name ZEOCAT P2-2) having a silicon/aluminum atomic ratio of at least 300, preferably from 300 to 1000.

The crystalline silicate, preferably of the silicalite or ZSM-5 types, catalyst is mixed with a binder, preferably an inorganic binder, and shaped to a desired shape, e.g. pellets. The binder is selected so as to be resistant to the temperature and other conditions employed in the catalyst manufacturing process and in the subsequent catalytic cracking process for the olefins. The binder is an inorganic material selected from clays, silica, metal oxides such as $ZrO_2$ and/or metals, or gels including mixtures of silica and metal oxides. The binder is preferably alumina-free. If the binder which is used in conjunction with the crystalline silicate is itself catalytically active, this may alter the conversion and/or the selectivity of the catalyst. Inactive materials for the binder may suitably serve as diluents to control the amount of conversion so that products can be obtained economically and orderly without employing other means for controlling the reaction rate. It is desirable to provide a catalyst having a good crush strength. This is because in commercial use, it is desirable to prevent the catalyst from breaking down into powder-like materials. Such clay or oxide binders have been employed normally only for the purpose of improving the crush strength of the catalyst. A particularly preferred binder for the catalyst of the present invention comprises silica.

The relative proportions of the finely divided crystalline silicate material and the inorganic oxide matrix of the binder can vary widely. Typically, the binder content ranges from 5 to 95% by weight, more typically from 20 to 50% by weight, based on the weight of the composite catalyst. Such a mixture of crystalline silicate and an inorganic oxide binder is referred to as a formulated crystalline silicate.

In mixing the catalyst with a binder, the catalyst may be formulated into pellets, extruded into other shapes, or formed into a spray-dried powder.

Typically, the binder and the crystalline silicate catalyst are mixed together by an extrusion process. In such a process, the binder, for example silica, in the form of a gel is mixed with the crystalline silicate catalyst material and the resultant mixture is extruded into the desired shape, for example pellets. Thereafter, the formulated crystalline silicate is calcined in air or an inert gas, typically at a temperature of from 200 to 900° C. for a period of from 1 to 48 hours.

The binder preferably does not contain any aluminum compounds, such as alumina. This is because as mentioned above the preferred catalyst for use in the invention is de-aluminated to increase the silicon/aluminum ratio of the crystalline silicate. The presence of alumina in the binder yields other excess alumina if the binding step is performed prior to the aluminum extraction step. If the aluminum-containing binder is mixed with the crystalline silicate catalyst following aluminum extraction, this re-aluminates the catalyst. The presence of aluminum in the binder would tend to reduce the olefin selectivity of the catalyst, and to reduce the stability of the catalyst over time.

In addition, the mixing of the catalyst with the binder may be carried out either before or after the steaming and extraction steps.

The steam treatment is conducted at elevated temperature, preferably in the range of from 425 to 870° C., more preferably in the range of from 540 to 815° C. and at atmospheric pressure and at a water partial pressure of from 13 to 200 kPa. Preferably, the steam treatment is conducted in an atmosphere comprising from 5 to 100% steam. The steam treatment is preferably carried out for a period of from 1 to 200 hours, more preferably from 20 hours to 100 hours. As stated above, the steam treatment tends to reduce the amount of tetrahedral aluminum in the crystalline silicate framework, by forming alumina.

Following the steam treatment, the extraction process is performed in order to de-aluminate the catalyst by leaching. The aluminum is preferably extracted from the crystalline silicate by a complexing agent which tends to form a soluble complex with alumina. The complexing agent is preferably in an aqueous solution thereof. The complexing agent may comprise an organic acid such as citric acid, formic acid, oxalic acid, tartaric acid, malonic acid, succinic acid, glutaric acid, adipic acid, maleic acid, phthalic acid, isophthalic acid, fumaric acid, nitrilotriacetic acid, hydroxyethylenediaminetriacetic acid, ethylenediaminetetracetic acid, trichloroacetic acid rifluoroacetic acid or a salt of such an acid (e.g. the sodium salt) or a mixture of two or more of such acids or salts. The complexing agent for aluminum preferably forms a water-soluble complex with aluminum, and in particular removes alumina which is formed during the steam treatment step from the crystalline silicate. A particularly preferred complexing agent may comprise an amine, preferably ethylene diamine tetraacetic acid (EDTA) or a salt thereof, in particular the sodium salt thereof.

Following the de-alumination step, the catalyst is thereafter calcined, for example at a temperature of from 400 to 800° C. at atmospheric pressure for a period of from 1 to 10 hours.

The various preferred catalysts of the present invention have been found to exhibit high stability, in particular being capable of giving a stable propylene yield over several days, e.g. up to ten days. This enables the olefin cracking process to be performed continuously in two parallel "swing" reactors wherein when one reactor is operating, the other reactor is undergoing catalyst regeneration. The catalyst of the present invention also can be regenerated several times. The catalyst is also flexible in that it can be employed to crack a variety of feedstocks, either pure or mixtures, coming from different sources in the oil refinery or petrochemical plant and having different compositions.

In the process for catalytic cracking of olefins in accordance with the invention, the present inventors have discovered that when dienes are present in the olefin-containing feedstock, this can provoke a faster deactivation of the catalyst. This can greatly decrease the yield on an olefin basis of the catalyst to produce the desired olefin, for example propylene, with increasing time on stream. The present inventors have discovered that when dienes are present in the feedstock which is catalytically cracked, this can yield a gum derived from the diene being formed on the catalyst which in turn decreases the catalyst activity. It is desired in accordance with the process of the invention for the catalyst to have a stable activity over time, typically for at least ten days.

In accordance with this aspect of the invention, prior to the catalytic cracking of the olefins, if the olefin-containing feedstock contains dienes, the feedstock is subjected to a selective hydrogenation process in order to remove the dienes. The hydrogenation process requires to be controlled in order to avoid the saturation of the mono-olefins. The hydrogenation process preferably comprises nickel-based or palladium-based catalysts or other catalysts which are typically used for first stage pyrolysis gasoline (Pygas) hydrogenation. When such nickel-based catalysts are used with a $C_4$ cut, a significant conversion of the mono-olefins into paraffins by hydrogenation cannot be avoided. Accordingly, such palladium-based catalysts, which are more selective to diene hydrogenation, are more suitable for use with the $C_4$ cut.

A particularly preferred catalyst is a palladium-based catalyst, supported on, for example, alumina and containing 0.2–0.8 wt % palladium based on the weight of the catalyst. The hydrogenation process is preferably carried out at an absolute pressure of from 5 to 50 bar, more preferably from 10 to 30 bar and at an inlet temperature of from 40 to 200° C. Typically, the hydrogen/diene weight ratio is at least 1, more preferably from 1 to 5, most preferably around 3. Preferably, the liquid hourly space velocity (LHSV) is at least $2h^{-1}$, more preferably from 2 to $5h^{-1}$.

The dienes in the feedstock are preferably removed so as to provide a maximum diene content in the feedstock of around 0.1% by weight, preferably around 0.05% by weight, more preferably around 0.03% by weight.

In the catalytic cracking process, the process conditions are selected in order to provide high selectivity towards propylene, a stable olefin conversion over time, and a stable olefinic product distribution in the effluent. Such objectives are favoured by the use of a low acid density in the catalyst (i.e. a high Si/Al atomic ratio) in conjunction with a low pressure, a high inlet temperature and a short contact time, all of which process parameters are interrelated and provide an overall cumulative effect (e.g. a higher pressure may be offset or compensated by a yet higher inlet temperature). The process conditions are selected to disfavour hydrogen transfer reactions leading to the formation of paraffins, aromatics and coke precursors. The process operating conditions thus employ a high space velocity, a low pressure and a high reaction temperature. Preferably, the LHSV ranges from 10 to $30h^{-1}$. The olefin partial pressure preferably ranges from 0.1 to 2 bars, more preferably from 0.5 to 1.5 bars. A particularly preferred olefin partial pressure is atmospheric pressure (i.e. 1 bar). The hydrocarbon feedstocks are preferably fed at a total inlet pressure sufficient to convey the feedstocks through the reactor. The hydrocarbon feedstocks may be fed undiluted or diluted in an inert gas, e.g. nitrogen. Preferably, the total absolute pressure in the reactor ranges from 0.5 to 10 bars. The present inventors have found that the use of a low olefin partial pressure, for example atmospheric pressure, tends to lower the incidence of hydrogen transfer reactions in the cracking process, which in turn reduces the potential for coke formation which tends to reduce catalyst stability. The cracking of the olefins is preferably performed at an inlet temperature of the feedstock of from 500 to 600° C., more preferably from 520 to 600° C., yet more preferably from 540 to 580° C., typically around 560° C. to 570° C.

The catalytic cracking process can be performed in a fixed bed reactor, a moving bed reactor or a fluidized bed reactor. A typical fluid bed reactor is one of the FCC type used for fluidized-bed catalytic cracking in the oil refinery. A typical moving bed reactor is of the continuous catalytic reforming type. As described above, the process may be performed continuously using a pair of parallel "swing" reactors.

Since the catalyst exhibits high stability to olefinic conversion for an extended period, typically at least around ten days, the frequency of regeneration of the catalyst is low. More particularly, the catalyst may accordingly have a lifetime which exceeds one year.

The olefin cracking process of the present invention is generally endothermic. Typically, propylene production from $C_4$ feedstocks tends to be less endothermic than from $C_5$ or light cracked naphtha feedstocks. For example for a light cracked naphtha having a propylene yield of around 18.4%, the enthalpy in was 429.9 kcal/kg and the enthalpy out was 346.9 kcal/kg. The corresponding values for a $C_5$-exLCN feedstock were yield 16.8%, enthalpy in 437.9 kcal/kg and enthalpy out 358.3 kcal/kg and for a $C_4$-exMTBE feedstock were yield 15.2%, enthalpy in 439.7/kg and enthalpy out 413.7 kcal/kg. Typically, the reactor is operated under adiabatic conditions and most typical conditions are an inlet temperature for the feedstock of around 570° C., an olefin partial pressure at atmospheric pressure and an LHSV for the feedstock of around $25h^{-1}$. Because the catalytic cracking process for the particular feedstock employed is endothermic, the temperature of the output effluent is correspondingly lowered. For example, for the liquid cracked naphtha, $C_5$-exLCN and the $C_4$-exMTBE feedstocks referred to above the typical adiabatic AT as a result of the endothermic process is 109.3, 98.5 and 31.1° C. respectively.

Thus for a $C_4$ olefinic stream, a temperature drop of around 30° C. would arise in an adiabatic reactor, whereas for LCN and $C_5$-exLCN streams, the temperature drop is significantly higher, namely around 109 and 98° C. respectively. If two such feedstocks are combined and fed jointly to the reactor, this can lead to a decrease in the overall heat duty of the selective cracking process. Accordingly, a blending of a $C_4$ cut with a $C_5$ cut or light cracked naphtha can reduce the overall heat duty of the process. Thus if for example a $C_4$ cut from the MTBE unit were combined with a light cracked naphtha to produce a composite feedstock, this decreases the heat duty of the process and leads to less energy being required to make the same amount of propylene.

After the catalytic cracking process, the reactor effluent is sent to a fractionator and the desired olefins are separated from the effluent. When the catalytic cracking process is employed to produce propylene, the $C_3$ cut, containing at least 95% propylene, is fractionated and thereafter purified in order to remove all the contaminants such as sulphur species, arsine, etc. The heavier olefins of greater than $C_3$ can be recycled.

The present inventors have found that the use of an MFI-type crystalline silicate, e.g. a silicalite, catalyst in accordance with the present invention which has been steamed and extracted, has particular resistance to reduction in the catalyst activity (i.e. poisoning) by sulphur-, nitrogen- and oxygen-containing compounds which are typically present in the feedstocks.

Industrial feedstocks can contain several kinds of impurities which could affect the catalysts used for cracking, for example methanol, mercaptans and nitrites in $C_4$ streams and mercaptans, thiophenes, nitrites and amines in light cracked naphtha.

Certain tests were performed to simulate feedstocks containing poisons wherein a feedstock of 1-hexene was doped with n-propylamine or propionitrile, each yielding 100 ppm by weight of N; 2-propyl mercaptan or thiophene, each yielding 100 ppm by weight of S; and methanol, yielding either 100 or 2000 ppm by weight of O. These dopants did not affect the catalyst performance, with respect to the activity of the catalyst over time.

The ability of the catalyst employed in accordance with the present invention to resist poisoning by impurities containing nitrogen is particularly important when the feedstock is subjected to a preliminary hydrogenation step as discussed hereinabove for the purpose of removing dienes from the feedstock. If nitrogen containing impurities are present in the feedstock, the hydrogenation step may yield the generation of ammonia in the feedstock prior to the cracking process. The present inventors have found that the use of the crystalline silicate catalyst of the MFI-type which has been heated in steam and subjected to an aluminum extraction process as discussed hereinabove is resistant to poisoning by ammonia which may have been so generated.

In accordance with various aspects of the present invention, not only can a variety of different olefinic feedstocks be employed in the cracking process, but also, by appropriate selection of the process conditions and of the particular catalyst employed, the olefin conversion process can be controlled so as to produce selectively particular olefin distributions in the resultant effluents.

For example, in accordance with a preferred aspect of the invention, olefin-rich streams from refinery or petrochemical plants are cracked into light olefins, in particular propylene. The light fractions of the effluent, namely the $C_2$ and $C_3$ cuts, can contain more than 95% olefins. Such cuts are sufficiently pure to constitute chemical grade olefin feedstocks. The present inventors have found that the propylene yield on an olefin basis in such a process can range from 30 to 50% based on the olefinic content of the feedstock which contains one or more olefins of $C_4$ or greater. In the process, the effluent has a different olefin distribution as compared to that of the feedstock, but substantially the same total olefin content.

In a further embodiment, the process of the present invention produces $C_2$ to $C_3$ olefins from a $C_5$ olefinic feedstock. The catalyst is of crystalline silicate having a silicon/aluminum ratio of at least 180, more preferably at least 300, and the process conditions are an inlet temperature of from 500 to 600° C., an olefin partial pressure of from 0.1 to 2 bars, and an LHSV of 10 to $30h^{-1}$, yielding an olefinic effluent having at least 40% of the olefin content present as $C_2$ to $C_3$ olefins.

Another preferred embodiment of the present invention provides a process for the production of $C_2$ to $C_3$ olefins from a light cracked naphtha. The light cracked naphtha is contacted with a catalyst of crystalline silicate having a silicon/aluminum ratio of at least 180, preferably at least 300, to produce by cracking an olefinic effluent wherein at least 40% of the olefin content is present as $C_2$ to $C_3$ olefins. In this process, the process conditions comprise an inlet temperature of 500 to 600° C., an olefin partial pressure of from 0.1 to 2 bars, and an LHSV of 10 to $30h^{-1}$.

The various aspects of the present invention are illustrated below with reference to the following non-limiting Example.

EXAMPLE 1

In this Example, a number of. runs wherein 1-hexene was catalytically cracked to produce inter alia propylene in the effluent were carried out using a silicalite catalyst. In order to demonstrate by simulation that the selective catalytic cracking process was operable when the olefinic feedstock stream contained at least one sulphur-,nitrogen- and/or oxygen-containing impurity, heteroatom impurity species were introduced into the 1-hexene synthetic feed prior to the catalytic cracking process in order to simulate such poisons.

In the catalytic cracking process, the catalyst comprised a silicalite catalyst available in commerce from the company UOP Molecular Sieve Plant under the trade name S115. The catalyst had been extruded to form an extrudate of silicalite formulated with silica binder, the formulated silicalite containing 50 wt % silicalite. The catalyst was subjected to a steaming step and a de-alumination step using EDTA as described hereinbelow.

Specifically, the S115 silicalite was treated at 550° C. with a steam atmosphere containing 72 vol % steam and 28 vol % nitrogen at atmospheric pressure for a period of 48 hours. Then 2 kg of the steamed silicalite was immersed in 8.4 litres of an aqueous solution containing 0.05M of $Na_2EDTA$ and refluxed for a period of 16 hours. The slurry was washed thoroughly with water. Subsequently, the catalyst was exchanged with $NH_4Cl$ (4.2 litres of 0.1N for 1 kg of catalyst) under reflux conditions and finally washed, dried at 110° C. and calcined at 400° C. for a period of 3 hours. Thereafter, 538 g of precipitated silica available from Degussa AG of Frankfurt, Germany under the trade name FK500 was mixed with 1000 ml of distilled water. The slurry was brought to a pH of 1 with nitric acid and mixed for a period of 1 hour. Subsequently, 526 g of the above-treated silicalite, 15 g of glycerol and 45 g of tylose were added to the silica slurry. The slurry was evaporated until a paste was obtained. The paste was extruded to form 1.6 mm cylindrical extrudates. The extrudates were dried at 110° C. for 16 hours and then calcined at 600° C. for 10 hours.

The chemical composition of the catalyst was analysed during various steps of its preparation process in terms of the amount of $Al_2O_3$ and $Na_2O$, and the silicon/aluminum atomic ratio, and the results are specified below.

| | Precursor | Steaming | Extraction | Extrusion | Exchange |
|---|---|---|---|---|---|
| $Al_2O_3$ (wt %) | 0.42 | 0.417 | 0.308 | 0.248 | 0.243 |
| Si/Al | 220 | 220 | 274 | 340 | 348 |
| $Na_2O$ (wt %) | 0.024 | 0.028 | 0.008 | 0.008 | 0.008 |

In the catalytic cracking process, the feedstock was introduced over the catalyst at an inlet temperature of around 585° C. at an outlet hydrocarbon pressure of atmospheric pressure, and at a rate having an LHSV of $25h^{-1}$.

In order to observe any effect on deactivation as a result of poisoning, the catalyst was tested under very demanding conditions, namely being diluted with a binder at a level of 50 wt % and at a high LHSV. Under these conditions, the conversion level of the feedstock is considerably below 100%, so that the poisoning effect can readily be seen.

Referring to FIG. 1, the graph shows the results of a first catalytic cracking run wherein the 1-hexene feedstock contained 2,000 ppm of nitrogen, the nitrogen having been present in propionitrile which was introduced into the feedstock during the run. FIG. 1 shows the relationship between the conversion of the 1-hexene feedstock with time, the propylene selectivity with respect to time and the propylene yield with respect to time. In the first run, initially for a period of over 20 hours, the end of the period being represented by the solid line in FIG. 1, 1-hexene was introduced into the reactor in the absence of the poison.

Thereafter, for a period of just over 20 hours, the end of which is defined by the second solid line on FIG. 1, the nitrogen-containing poison was introduced into the reactor. Thereafter, the poison introduction was stopped and the process continued up to a total process time of around 70 hours.

It may be seen that both the 1-hexene conversion and the yield of propylene decrease during the period wherein the poison was introduced. However, the propylene selectivity i.e. the yield of propylene on an olefin basis, remained substantially constant over the run. Thus during loss of hexene conversion, the propylene selectivity does not change.

FIGS. 2 to 10 are similar to FIG. 1 and represent the results of different runs of the catalytic cracking process employing different poisons and different amounts of poisons as specified in those Figures. It may be seen from those Figures that again the propylene selectivity substantially remains constant during the poisoning period.

It should be noted that from the various graphs that only nitrogen-containing compounds have a small effect on conversion when present in very high concentrations, e.g. 2000 wppm of N, which is generally well above what is found in industrial olefinic feedstocks of interest in connection with the present invention, i.e. $C_4$, LCN, etc. The remaining hetero-atom-containing compounds do not have any effect on catalyst performance.

What is claimed is:

1. A process for the catalytic cracking of at least one olefin in an olefinic stream containing impurities, the cracking process being selective towards light olefins in the effluent, the process comprising contacting at an inlet temperature of from 500 to 600° C. a feedstock olefinic stream containing at least 100 ppm of at least one impurity selected from the group consisting of nitrogen, sulphur and oxygen with a MFI crystalline silicate catalyst, the catalyst having been heated in steam to reduce the tetrahedral aluminum in the crystalline silicate framework and subjected to an aluminum extraction process to remove aluminum from the pores of the crystalline silicate after which the catalyst has a silicon/aluminum atomic ratio of from 180 to 1000, to produce an effluent stream having substantially the same olefinic content by weight as, but a different olefin distribution than, the feedstock contains.

2. A process according to claim 1, wherein the catalyst is selected from the group consisting of silicalite and ZSM-5.

3. A process according to claim 1, wherein the feedstock comprises a light cracked naphtha.

4. A process according to claim 1, wherein the feedstock is selected from the group consisting of a $C_4$ cut from a fluidised-bed catalytic cracking unit in a refinery, a $C_4$ cut from a unit in a refinery for producing methyl tert-butyl ether and a $C_4$ cut from a steam-cracking unit.

5. A process according to claim 1, wherein the feedstock is selected from the group consisting of a $C_5$ cut from a steam cracker and light cracked naphtha.

6. A process according to claim 1, wherein the catalytic cracking has a propylene yield on an olefin basis of from 30 to 50% based on the olefin content of the feedstock.

7. A process according to claim 1, wherein the feedstock contacts the catalyst at an olefin partial pressure of from 0.1 to 2 bar.

8. A process according to claim 1, wherein the feedstock is passed over the catalyst at an LHSV of from 10 to $30h^{-1}$.

9. A process according to claim 1, wherein the feedstock has a maximum diene concentration therein of 0.1 wt %.

10. A process according to claim 9, wherein the dienes have been removed from the feedstock prior to the cracking step by selective hydrogenation.

11. A process according to claim 1 wherein the catalyst has a silicon/aluminum atomic ratio of 300 to 1000.

12. A process according to claim 11 wherein the catalyst is selected from the group consisting of silicalite and ZSM-5.

13. A process according to claim 12 wherein the catalyst has a silicon/aluminum atomic ratio within the range of 300–500.

14. A process for the catalytic cracking of at least one olefin in an olefinic stream containing dienes and impurities, including at least one impurity selected from the group consisting of nitrogen-, sulphur-, and oxygen-containing compounds, the cracking process being selective towards light olefins in the effluent, the process comprising selectively hydrogenating dienes in said stream to provide a maximum diene concentration therein of 0.1 weight percent and thereafter contacting at an inlet temperature of from 500 to 600° C. the resulting feedstock olefinic stream containing at least 100 ppm of at least one impurity selected from the group consisting of nitrogen, sulphur and oxygen with a MFI crystalline silicate catalyst, the catalyst having been heated in steam to reduce the tetrahedral aluminum in the crystalline silicate framework and subjected to an aluminum extraction process to remove aluminum from the pores of the crystalline silicate after which the catalyst has a silicon/aluminum atomic ratio of from 180 to 1000, to produce an effluent stream having substantially the same olefinic content by weight as, but a different olefin distribution than, the feedstock stream.

15. The process of claim 14 wherein the maximum diene content of said feedstock olefinic stream after the selective hydrogenation step is no more than 0.05 wt. %.

16. The process of claim 14 wherein the maximum diene content said feedstock olefinic stream after the selective hydrogenation step is no more than 0.03 wt. %.

17. The process of claim 14 wherein said at least one impurity comprises nitrogen.

18. The process according to claim 14 wherein said at least one impurity comprises sulfur.

19. The process according to claim 14 wherein the catalyst is selected from the group consisting of silicalite and ZSM-5.

20. The process according to claim 19 wherein said catalyst has a silicon/aluminum atomic ratio within the range of 300–500.

21. A process for the catalytic cracking of at least one olefin in an olefinic stream containing impurities, the cracking process being selective towards light olefins in the effluent, the process comprising contacting at an inlet temperature of from 500 to 600° C. a feedstock olefinic stream containing at least 100 ppm of at least one impurity selected from the group consisting of nitrogen, sulphur and oxygen with a MFI crystalline silicate catalyst, the catalyst having been heated in steam to reduce the tetrahedral aluminum in the crystalline silicate framework and subjected to an aluminum extraction process to remove aluminum from the pores of the crystalline silicate after which the catalyst has a silicon/aluminum atomic ratio of from 180 to 1000, to produce an effluent stream having substantially the same olefinic content by weight as, but a different olefin distribution than, the feedstock contains, wherein the olefin contents by weight of the feedstock and the effluent are within ±15% of each other.

* * * * *